US005658206A

United States Patent [19]

Antonious

[11] Patent Number: 5,658,206

[45] Date of Patent: Aug. 19, 1997

[54] GOLF CLUB WITH OUTER PERIPHERAL WEIGHT CONFIGURATION

[76] Inventor: Anthony J. Antonious, 205 E. Joppa Rd., Unit 1603, Towson, Md. 21386-3260

[21] Appl. No.: 599,405

[22] Filed: Nov. 22, 1995

[51] Int. Cl.[6] ..... A63B 53/04

[52] U.S. Cl. ..... 473/328; 473/349; 473/350

[58] Field of Search ..... 473/328, 349, 473/350, 290, 291, 324, 344; D21/220

[56] References Cited

U.S. PATENT DOCUMENTS

| | | | |
|---|---|---|---|
| D. 184,054 | 12/1958 | Huthsing | 473/328 |
| 3,068,011 | 12/1962 | Sano | 473/328 |
| 3,961,796 | 6/1976 | Thompson | 473/328 |
| 4,854,580 | 8/1989 | Kobayashi | 473/290 |
| 5,046,733 | 9/1991 | Antonious | 473/350 |
| 5,125,662 | 6/1992 | Antonious | 473/328 |
| 5,390,924 | 2/1995 | Antonious | 473/328 |
| 5,447,311 | 9/1995 | Viollaz | 473/350 |
| 5,474,297 | 12/1995 | Levin | 473/328 |

FOREIGN PATENT DOCUMENTS

| | | |
|---|---|---|
| 608128 | 7/1994 | European Pat. Off. . |
| 377463 | 7/1932 | United Kingdom . |

*Primary Examiner*—Sebastiano Passaniti

*Attorney, Agent, or Firm*—Finnegan, Henderson, Farabow, Garrett & Dunner, L.L.P.

[57] ABSTRACT

An iron type golf club head having a secondary outermost perimeter weight extending outwardly from the outer peripheral surfaces of the club head in the form of an outermost keel-shaped weight member which further displaces the mass of the club head from the center of percussion.

17 Claims, 5 Drawing Sheets

FIG. 4
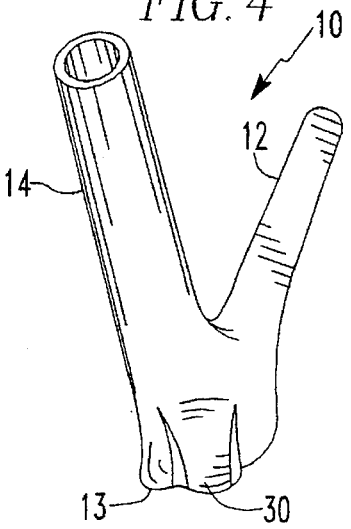
FIG. 5
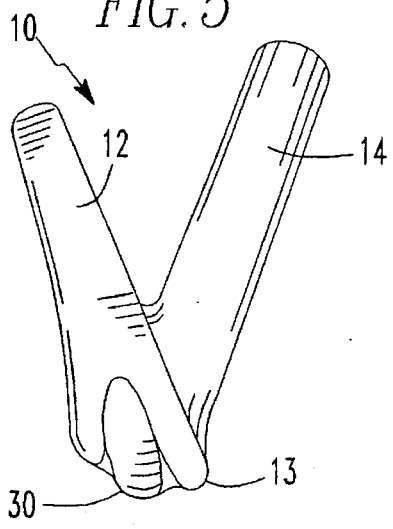
FIG. 6
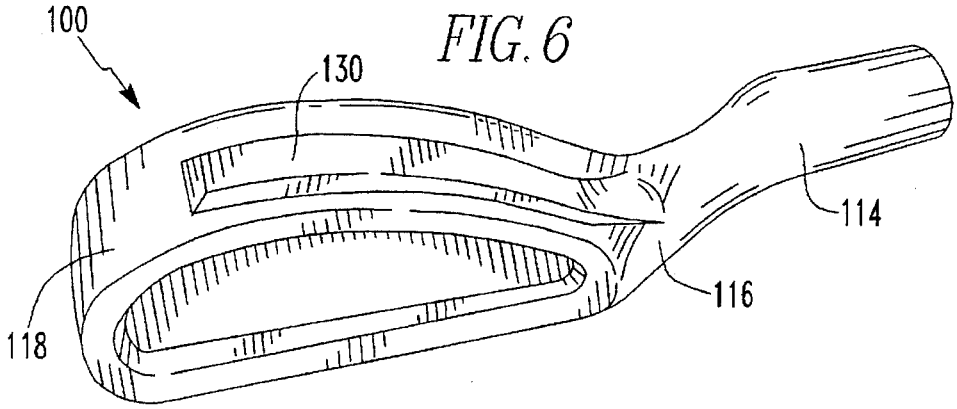
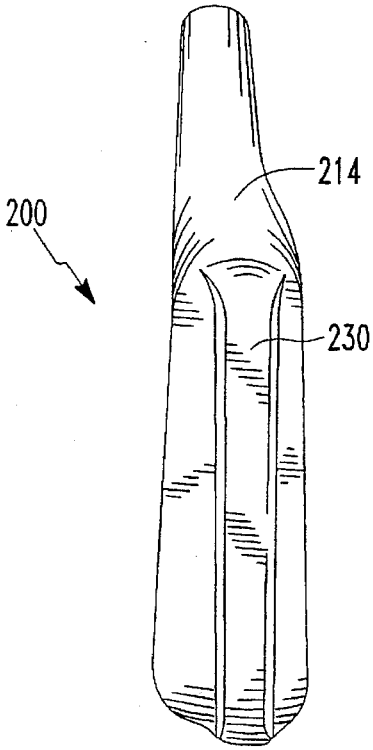
FIG. 7

FIG. 12
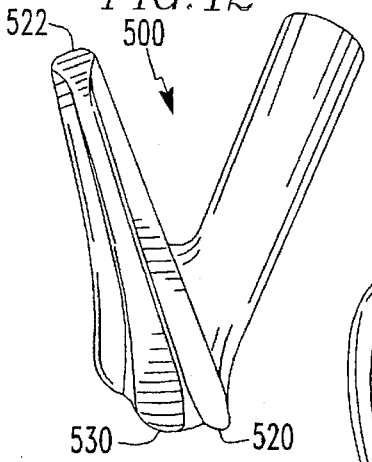
FIG. 13
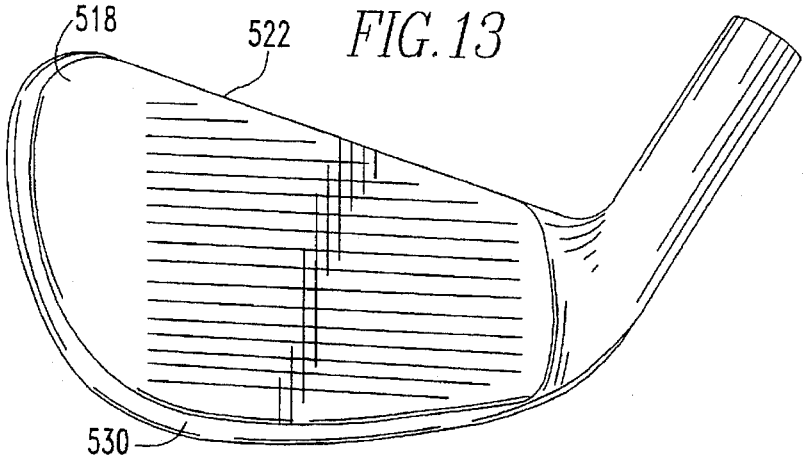
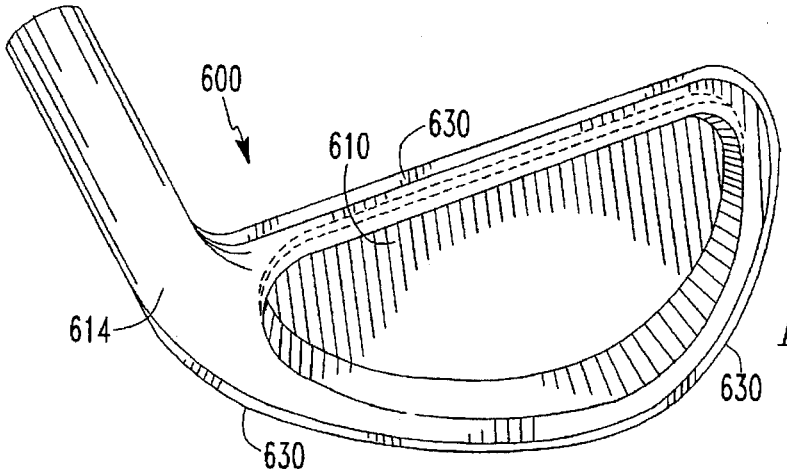
FIG. 14
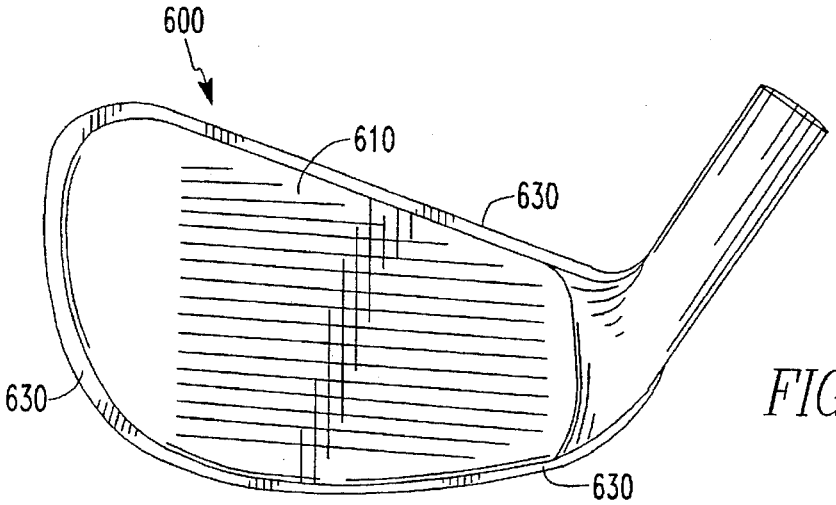
FIG. 15

GOLF CLUB WITH OUTER PERIPHERAL WEIGHT CONFIGURATION

BACKGROUND AND SUMMARY OF THE INVENTION

The present invention relates to an iron-type golf club head and particular to an iron-type golf club head having an improved outer perimeter weight configuration.

It is well know that iron-type golf club heads that have an outer perimeter weight tend to be more forgiving when shots are miss hit, thereby imparting more energy to the ball struck off of the center of percussion. There has been a trend in the golf club industry to provide larger golf club heads in order to further extend the peripheral weight to achieve peripheral weighting characteristics.

The present invention relates to an iron-type golf club head having a secondary outermost perimeter weight configuration in the form of a keel-shaped weight member extending at least part way around and outwardly from the club head. The keel-shaped weight member locates more mass outwardly from the center of percussion to the outer periphery while eliminating the need for actually enlarging the overall profile of a standard size club head. The keel-shaped weight member may extend from the lower heel area across the sole surface, up the toe portion and across the top ridge surface, thereby defining a more effective weight distribution around the outer periphery of the club head all the way to the point where the club head is attached to the hosel.

The keel-shaped weight configuration, which in this preferred embodiment, practically surrounds the entire hitting area of the club face, cooperates with the peripheral mass of the club head creating a unitized outer weight configuration heretofore unknown in the golf club art. This arrangement of weight provides a most effective and precise distribution of mass thereby permitting an optimum transfer of energy to the entire hitting area of the club face while substantially enlarging the sweet spot and making it greater than a comparably sized club head. The unitized outer weight configuration provides greater club head control and increased stability at impact, regardless of where the ball contact is made on the club face, resulting in less torque and turning of the club head during the execution of the shot. The elongated longitudinal shape of the outer weight member, on the sole portion of the club head, also acts as a deflector or skimmer, allowing the club head to glide smoothly over the turf when making ground contact rather than bouncing causing a thin shot or embedding the leading edge into the ground. This bouncing or embedding results in decreased club head speed and possible adverse or painful sensations which can be caused by the shock and vibrations that occur when ground contact occurs.

In a preferred embodiment of the present invention, a conventional golf club head is provided with a keel-shaped outermost longitudinal weight member located approximately mid-way between the front and rear of the club head, and around most, if not all, the entire peripheral edge of the club head. The outermost weight member may be rectangular, circular, semi-circular or any other geometrical shape providing minimum aerodynamic and ground contact drag. Preferably, the outermost keel weight configuration will transition into the hosel providing a much more rigid, unitized connection between the hosel and the club body to further solidify the connection between the club head body and the hosel thereby allowing maximum transfer of power generated from the hands and arms of the player, through the shaft hosel and into the club head itself.

In another preferred embodiment, the outermost keel-shaped weight member may extend around the entire outer periphery of the club head including the top ridge area.

Alternately, the outermost weight member may extend part way along the sole of the club head as well as extending part way from the sole surface into the heel and toe areas of the club head. The outermost keel weight may be positioned close to the front or close to the rear surface of the club head, depending upon the desired performance characteristics of the individual club head.

In other embodiments, the outermost keel-shaped weight configuration is formed on only a portion of the sole. Other embodiments use an outermost keel-shaped weight which extends part way along the toe portion and heel or hosel portions of the club head.

It will be appreciated that the provision of the outermost, keel-shaped weight configuration may be equally applicable to golf club heads having a flat or muscle back configuration.

Among the objects of the present invention are the provision of an iron-type golf club head having improved weight characteristics. Another object is the provision of a iron-type golf club head having an increased outermost peripheral weight structure which allows maximum transfer of energy to a golf ball, particularly when it is struck off of the center of percussion.

Still another object of the present invention is the provision of an outermost peripheral weight configuration formed on the sole surface of the golf club head which acts to stabilize the club head and prevent or minimize it from being embedded deeply into the turf during the execution of a golf shot.

These and other objects of the present invention will become apparent with reference to the following specification and drawings.

BRIEF DESCRIPTION OF THE DRAWINGS

FIG. 4 is a heel end elevational view of the club head of FIG. 1.

FIG. 5 is a toe end elevational view of the club head of FIG. 1.

FIG. 6 is a bottom view of a second embodiment of a golf club head of the present invention.

FIG. 7 is a bottom view of a third embodiment of a golf club head of the present invention.

FIG. 12 is an end elevational view of the golf club head of FIG. 11.

FIG. 13 is a front elevational view of the golf club head of FIG. 11.

FIG. 14 is a rear elevational view of a seventh embodiment of a golf club head of the present invention.

FIG. 15 is a front elevational view of the golf club head of FIG. 14

DESCRIPTION OF THE PREFERRED EMBODIMENTS

Figure 1:
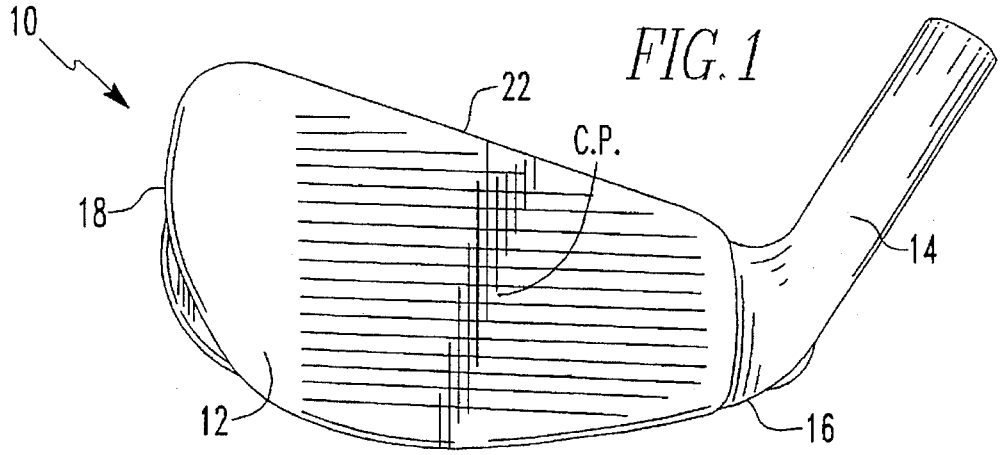
FIG. 1 is a front elevational view of a first embodiment of a golf club head of the present invention.
Figure 2:
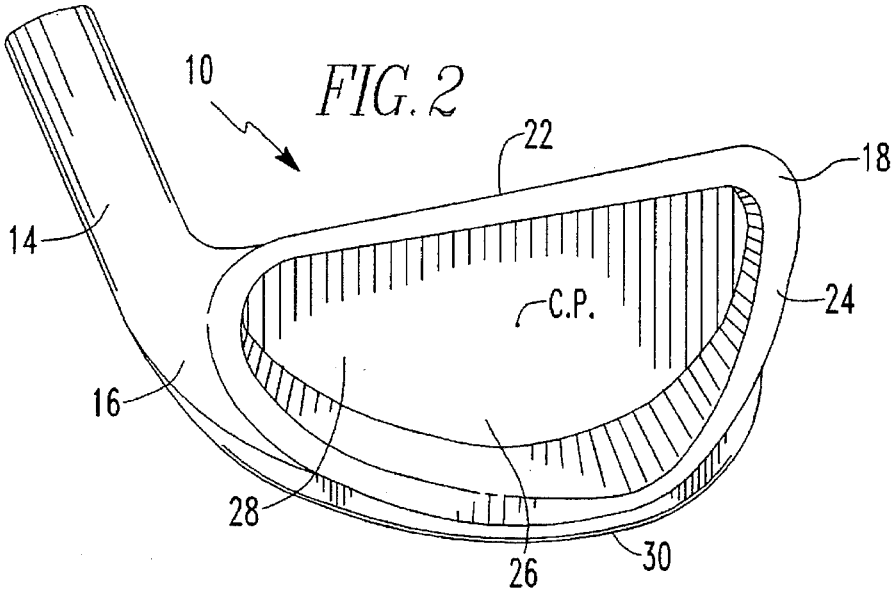
FIG. 2 is a rear elevational view of the club head of FIG. 1.
Figure 3:
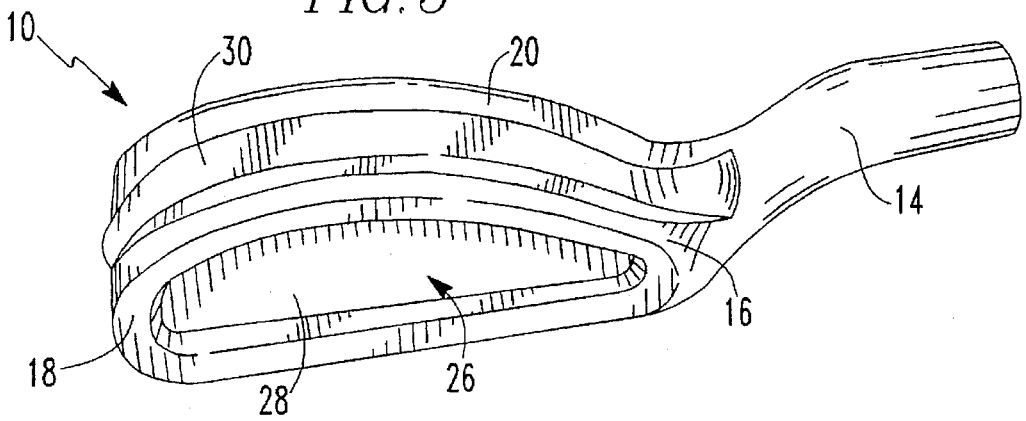
FIG. 3 is a bottom view of the club head of FIG. 1.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

FIGS. 1–5 show a first embodiment of an iron type golf club head 10 having a ball striking face 12 with a loft angle of at least 10 degrees and a leading edge 13, a hosel 14, heel 16, toe 18, bottom sole 20, top ridge 22, a peripheral weight 24 forming a rear cavity 26, and a rear surface 28 having a trailing edge 29. In this embodiment, a keel-shaped elongated longitudinal weight member 30 is shown formed on the bottom sole 20 of the club head 10 extending from the heel 16 to the toe 18 and connecting with and smoothly transitioning into the hosel 14. The keel-shaped weight member 30 transfers the overall mass toward the periphery of the club head 10 further removed from the center of percussion, c.p. The weight member 30 is positioned generally parallel to and between the leading edge 13 and trailing edge 29. In this embodiment, the weight of the club head 10 is shifted toward the lower portion of the club head 10 allowing a player to hit a golf ball higher because of the increased weight at the lower areas of the club head. Furthermore, the keel-shaped weight member 30 engages the turf during the execution of a golf shot preventing the club from digging into the turf during the execution of a golf swing, which could result in a loss of power and possible injury to the hands of the player due to the impact and vibration forces. In this particular embodiment, the weight member 30 is positioned along the middle of the bottom sole, between the striking face 12 and the rear surface 28 of the club head 10. In the toe area, the weight member 30 extends upwardly and smoothly transitions into the toe 18 of the club head.

FIG. 6 shows a second embodiment of a golf-club head 100 having the same configuration and characteristics as the embodiment described with respect to FIGS. 1–5 hereinabove, except that the keel-shaped weight member 130 extends from the heel 114 to a point adjacent the toe 118 of the club head 100 and does not extend from the bottom surface 120 onto the toe 118. In this embodiment, the weight member preferably is spaced from the toe portion of the club head 10 and extends slightly upwardly to form a connection with the hosel 114.

FIG. 7 shows a third embodiment of club head 200 in which a keel-shaped weight member 230 extends to or into the toe 218 and does not extend onto the heel 216 or hosel 214 of the club head 200. This embodiment otherwise is like that shown in FIGS. 1–5.

Figure 8:
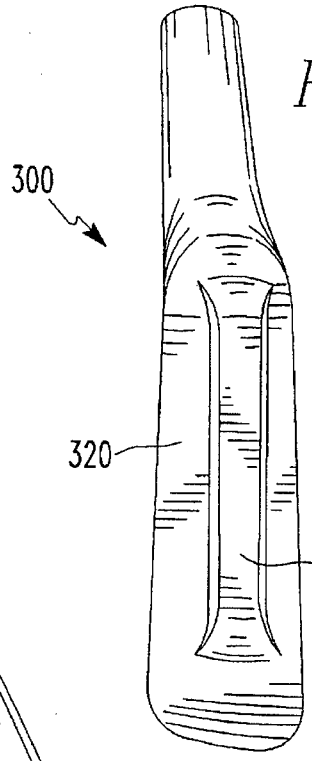
FIG. 8 is a bottom view of a fourth embodiment of a golf club head of the present invention.

FIG. 8 shows a forth embodiment of a club head 300 in which a keel-shaped weight member 330 is confined to the sole or bottom surface 320 of the club head 300. The weight member 330 is centrally positioned along the bottom sole 320 and extends proximate to but spaced from the toe 318 and heel 316 of the club head.

Figure 9:
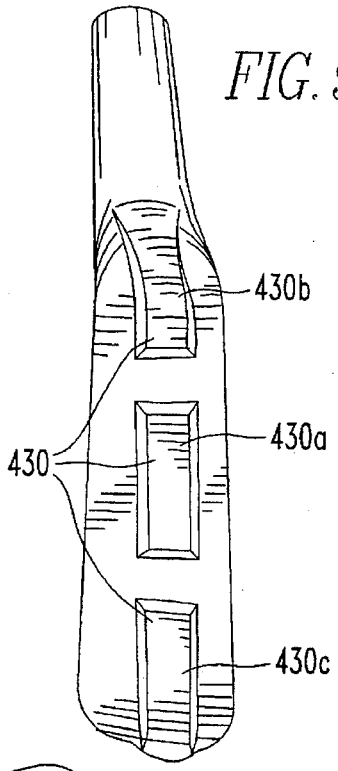
FIG. 9 is a bottom view of a fifth embodiment of a golf club head of the present invention.
Figure 10:
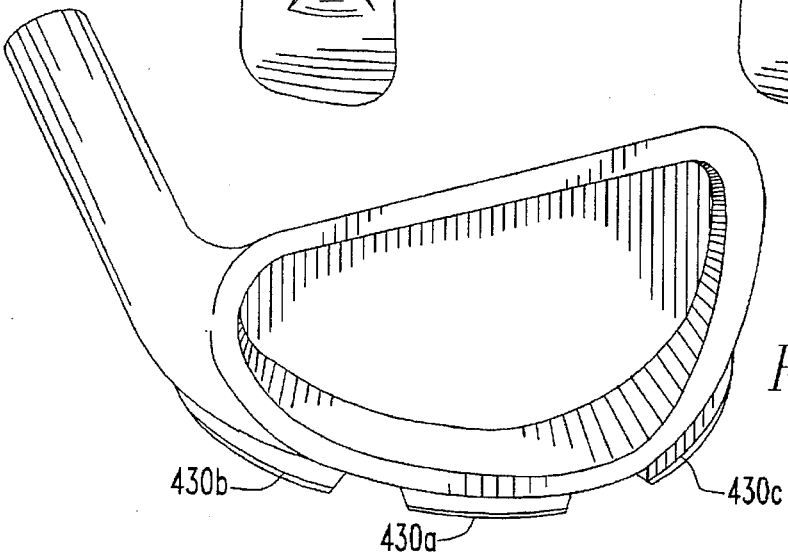
FIG. 10 is a rear elevational view of the golf club head of FIG. 9.

FIGS. 9 and 10 show a fifth embodiment of a club head 400 including a keel-shaped weight member 430 formed in separate sections including a central section **430*a*, a heel section 430*b* and toe section 430*c*. In this embodiment the heel section 430*b* extends into and smoothly transitions into the heel 418 and hosel 414. The toe section 430*c* extends into and smoothly transitions into the toe 418 of the club head 400**.

Figure 11:
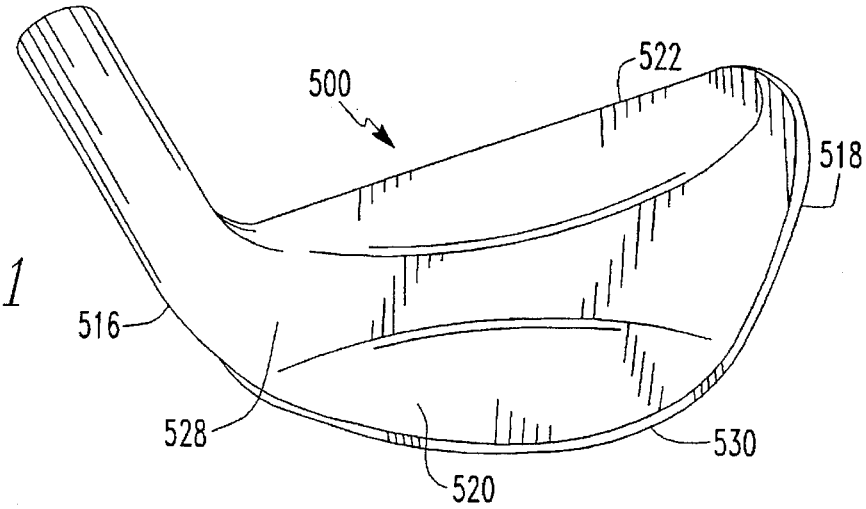
FIG. 11 is a rear elevational view of a sixth embodiment of a golf club head of the present invention.

FIGS. 11, 12 and 13 show a sixth embodiment of a golf club head 500 having a flat or muscle back configuration on a rear surface 528 in which a keel-shaped weight member 530 extends all the way from the heel 516, across the bottom surface 520 to the point where the toe 518 intersects with the top ridge 522. In this embodiment, the weight member 530 preferably is connected with and transitions into the hosel 514.

FIGS. 14, and 15 show a seventh embodiment of club head 600 having a keel-shaped weight member 630 extending around the entire periphery of the club head 600 except for the point where the hosel 614 connects to the club head body 610. In this embodiment, the weight member 630 preferably transitions into and connects with the hosel 614 at both bottom and top, thereby providing a very solid, unitized connection between the club head body 610 and the hosel 614.

Figure 16:
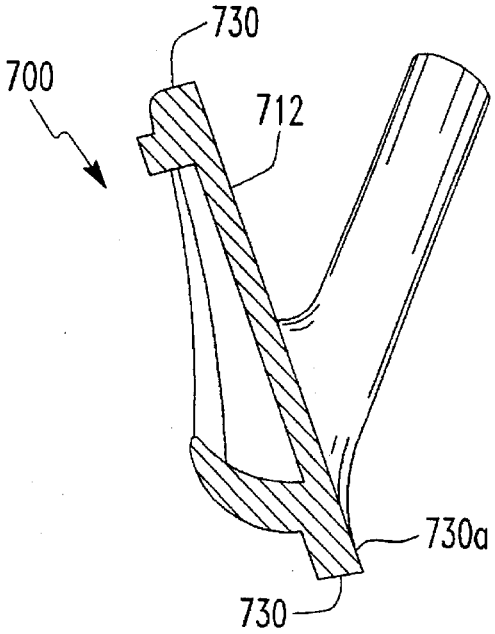
FIG. 16 is a sectional end view of an eighth embodiment of a golf club head of the present invention.

FIG. 16 shows an end sectional view of an eighth embodiment of a golf club head 700 of the present invention wherein an outer, keel-shaped, weight member 730 is located adjacent the ball striking face 712 and includes a front surface **730*a* aligned with the ball striking face 712**.

Figure 17:
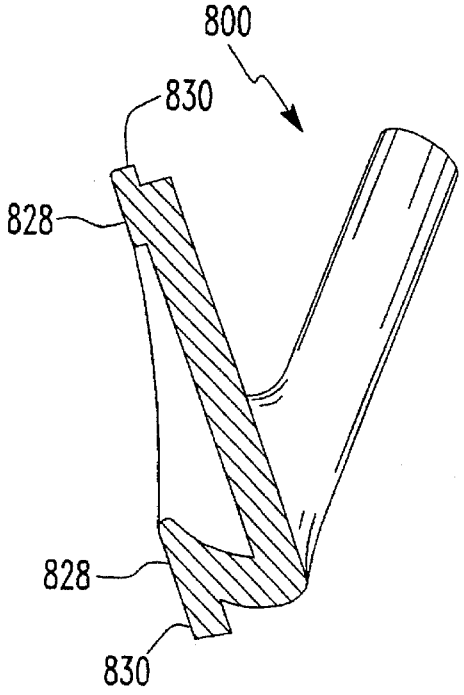
FIG. 17 is a sectional end view of a ninth embodiment of a golf club head of the present invention.

FIG. 17 shows an end sectional view of a ninth embodiment of a golf club head 800 of the present invention wherein an outer keel-shaped weight member 830 is located adjacent a rear surface 828 of the club head 800. Preferably a rear surface **830*a* of the weight member 830 is aligned with the rear surface 828**.

While various preferred embodiments have been shown and described, it will be understood that there is no intent to limit the invention by such disclosure, but rather, is intended to cover all modifications and alternate constructions falling within the spirit and scope of the invention as defined in the appended claims.

I claim:

1. An iron type golf club head comprising: a hosel, a club head body including a heel, a toe, a ball striking face having a face loft angle exceeding 10 degrees and a leading edge, a bottom sole, a top ridge surface, rear surface having a trailing edge, and an outer weight member formed generally parallel to and extending outwardly from peripheral edges of said club head, at least a part of said outer weight member being located on said bottom sole and extending in a direction generally parallel to said leading and trailing edges, said weight member extending outwardly from said heel, from said bottom sole, and from said toe and terminating at said top ridge surface.

2. The golf club head of claim 1 wherein said outer weight member on the bottom sole has a longitudinal keel-shaped configuration.

3. The club head of claim 1 wherein said outer weight member is located more proximate said ball striking face than said rear face.

4. The club head of claim 1 wherein said outer weight member is located more proximate said rear surface than said rear face.

5. The club head of claim 1 wherein said outer weight member transitions into and is connected with said hosel providing an interconnection between said hosel and said club head body.

6. An iron type golf club head comprising: a hosel, a club head body including a heel, a toe, a ball striking face having a face loft angle exceeding 10 degrees and a leading edge, a bottom sole, a top ridge surface, a rear surface having a trailing edge, and an elongated outer weight member having a single longitudinal axis along its length heel-to-toe direction, said outer weight member being formed generally parallel to and extending outwardly from peripheral edges of said club head, at least a part of said outer weight member being located on said bottom sole and extending in a direction generally parallel to said leading and trailing edges.

7. The club head of claim 6 wherein said outer weight member extends at least half of the length between said toe to said heel.

8. The club head of claim 6 wherein said outer weight member is formed of a plurality of sections.

9. The club head of claim 6 wherein said outer weight member is located only on said bottom sole.

10. The club head of claim 6 wherein said outer weight member extends around the entire periphery of said club head body from said heel, across said bottom sole, along said toe, and along said top ridge surface, and wherein said outer weight member joins said hosel at the interface of the hosel and the top ridge surface.

11. An iron type golf club head comprising: a hosel, a club head body including a heel, a toe, a ball striking face having a face loft angle exceeding 10 degrees and a leading edge, a bottom sole, a top ridge surface, a rear surface having a trailing edge, an elongated outer weight member formed generally parallel to and extending outwardly from peripheral edges of said club head, at least a part of said outer weight member being located on said bottom sole in a direction generally parallel to said leading and trailing edges, a portion of said outer weight member transitioning into and connecting with said hosel, thereby providing a strengthening interconnection between said hosel and said club head body.

12. The golf club head of claim 11 wherein said outer weight member extends part way along the toe and heel of said club head.

13. The golf club head of claim 11 wherein said outer weight member on the bottom sole is substantially rectangular in cross section.

14. The golf club head of claim 11 wherein said outer weight member on the bottom sole is substantially arcuate in cross section.

15. The golf club head of claim 11 wherein said outer weight member smoothly transitions into the toe of the club head.

16. The golf club head of claim 11 wherein said outer weight member is a single, integral member having a single longitudinal axis along its length.

17. The golf club head of claim 11 wherein said outer weight member extends along the toe and top ridge of the club head and also transitions into and is connected with the hosel proximate the intersection of the top ridge and the hosel.

* * * * *